US006269755B1

(12) United States Patent
Boswell et al.

(10) Patent No.: US 6,269,755 B1
(45) Date of Patent: Aug. 7, 2001

(54) BURNERS WITH HIGH TURNDOWN RATIO

(75) Inventors: John J. Boswell, Palm Beach Gardens, FL (US); Dale R. Eichmeyer, Lebanon, MO (US)

(73) Assignee: Independent Stave Company, Inc., Lebanon, MO (US)

( * ) Notice: Subject to any disclaimer, the term of this patent is extended or adjusted under 35 U.S.C. 154(b) by 0 days.

(21) Appl. No.: 09/363,470

(22) Filed: Jul. 29, 1999

Related U.S. Application Data

(60) Provisional application No. 60/095,054, filed on Aug. 3, 1998.

(51) Int. Cl.[7] ..... F23D 1/02; F23C 1/10; F23C 1/12; F23B 5/00; F23G 7/06

(52) U.S. Cl. ..... 110/264; 110/261; 110/262; 110/265; 110/263; 110/210; 110/214

(58) Field of Search ..... 110/260–265, 182.5, 110/210, 211, 212, 213, 214, 238, 116

(56) References Cited

U.S. PATENT DOCUMENTS

| | | | | |
|---|---|---|---|---|
| 473,143 | * | 4/1892 | Coze | 110/115 |
| 715,494 | * | 12/1902 | Maslin et al. | 110/115 |
| 1,932,455 | | 10/1933 | Freiday . | |
| 2,907,288 | | 10/1959 | Blomquist . | |
| 2,967,495 | | 1/1961 | DeHaan . | |
| 3,180,289 | | 4/1965 | Steinert . | |

(List continued on next page.)

*Primary Examiner*—Denise L. Ferensic
*Assistant Examiner*—K. B. Rinehart
(74) *Attorney, Agent, or Firm*—Peter S. Gilster; Greensfelder, Hemker & Gale, P.C.

(57) ABSTRACT

Various burner configurations for combustion of a particulate fuel such as sawdust, and many types of varying moisture content biomass fuels such as poultry litter. The burners exhibit a high turndown ratio. the burners include a housing defining an upright combustion chamber lined with refractory material and generally circular cross section, a main combustion region within an upper extent the combustion chamber, an initial combustion zone at a lower end of the combustion chamber of reduced-size cross-section compared to the combustion chamber and a transition region increasing in cross-section from the initial combustion zone to the main combustion region. A principal fuel (e.g., sawdust) is supplied with combustion air to the initial combustion region, and an auxiliary ignition fuel supplies heat to the initial combustion region for igniting the principal fuel. Multiple sets of tuyeres are provided for controllably introducing combustion air tangentially regions of the combustion chamber for contributing to cyclonic combustion flow in such a manner as to increase diameter of combustion upwardly within the combustion chamber. A counterflow arrangement, e.g., counterflow tuyere, disrupts cyclonic flow near a ceiling of the combustion chamber, through which a choke or exit provide escape from the combustion chamber of exhaust gases resulting from combustion. In operation, the principal fuel is ignited in the initial combustion region, and burns with cyclonic flow extending upwardly through the transition region with increasingly greater combustion diameter into the combustion chamber. A smoke or combustible gas combustor may be combined into the burner, so that that burner provides its high temperature air for preheat purposes to the combustor, which includes a venturi at which further combustion air is introduced for complete combustion in a gas combustion chamber of the combustor.

9 Claims, 8 Drawing Sheets

U.S. PATENT DOCUMENTS 3,190,245 * 6/1965 Huntington ..... 110/28
3,831,535 8/1974 Baardson .
3,834,326 9/1974 Sowards .
4,015,546 4/1977 Paules .
4,027,602 6/1977 Mott .
4,263,887 4/1981 Dowdall .
4,289,481 * 9/1981 Yano ..... 432/96
4,294,178 10/1981 Borio et al. .
4,312,278 1/1982 Smith et al. .
4,318,355 3/1982 Nelson .
4,334,484 6/1982 Payne et al. .
4,389,979 6/1983 Saxlund .
4,545,309 10/1985 Comtois .
4,548,138 10/1985 Korenberg .
4,561,364 * 12/1985 Green et al. ..... 110/347
4,565,137 * 1/1986 Wright ..... 110/264
4,565,184 1/1986 Collins et al. .
4,655,148 4/1987 Winship .
4,672,900 6/1987 Santalla et al. .
4,766,851 8/1988 Emsperger et al. .
4,785,744 * 11/1988 Fontaine ..... 110/214
4,850,288 7/1989 Hoffert et al. .
5,054,405 * 10/1991 Walker ..... 110/254
5,146,858 9/1992 Tokuda et al. .
5,199,357 4/1993 Garcia-Mallol .
5,200,155 * 4/1993 Obermueller ..... 422/182
5,279,234 1/1994 Bender et al. .
5,408,942 4/1995 Young .
5,678,494 * 10/1997 Ulrich ..... 110/224
5,950,547 * 9/1999 Wachendorfer ..... 110/263

* cited by examiner

BURNERS WITH HIGH TURNDOWN RATIO

This application claim benefit to U.S. provisional application No. 60/095,054 Aug. 3, 1998.

BACKGROUND OF THE INVENTION

1. Field of the Invention

The invention is in the field of industrial burners and incinerators and, more particularly, relates to new industrial burners for combustion of particulate fuels such as wet or dry sawdust and many types of varying moisture content biomass fuels including, agricultural products, wood waste, bagasse, poultry waste, and other cellulosic materials, and especially in the wood products manufacturing or processing operations, including combustion of smoke or other combustible gases produced by processes relating to such products and other gases, such as industrial off-gases, and specifically operating with high turndown ratios and high heat release ratios.

2. Related Art

In the general field of burners and incinerators for industrial purposes, there are myriad different configurations, wherein there has for many years been an increasing focus on efficiency and output. Thus, there have been proposals for swirling or cyclonic combustion and combustion chambers of unusual geometries, as well as many proposals for controlling the entry of air and fuel into the combustion chamber for contributing to swirling or other patters of combustion motion. There have been various burners proposed for burning, as feed stocks, organics or biomass materials, including so-called green (high moisture content) sawdust, solid cellulosic or wood-containing waste, waste wood, and fragments of wood, and all of which may herein be referred to as wood products.

In burners useful for burning such materials, there has been insufficient emphasis on achieving efficiency and flexibility which can result from achieving a high turndown ratio (which may for convenience be abbreviated "TDR"). Turndown ratio is the maximum firing rate of the burner divided by the minimum firing rate of the burner. Prior constructions have not achieved sufficiently high TDRs.

The provision of a high TDR for a burner capable of carrying out combustion of wood products is highly desirable, as such a burner would be capable of being operated over a great dynamic range. If, for example, in a manufacturing or materials handling operation which creates such wood products, which are to be combusted (as for heating or energy extraction for other processes or purposes), the use of a burner having a limited TDR can require that burner operation be terminated if wood product supply rates are insufficient to achieve the minimum firing rate of the burner. Or, if combustion of wood products at low feed rates is to be carried out, an auxiliary fuel such as natural gas, liquefied petroleum (LP) gas, propane, or fuel oil, may have to be fed into the burner for maintaining combustion. But, on the other hand if the burner is designed for burning wood products at low feed rates, its output may be insufficient to handle high feed rates when wood products to be combusted are being produced at high volumes. Further, if TDR can be increased, much less auxiliary fuel will be required to initiate burner operation.

As an example, in a wood products manufacturing or processing operations, very substantial quantities of green sawdust are created during sawing, planing, shaping, etc., but the rate of production of sawdust will be dependent upon the various wood-handling processes, which vary in rate, time of operation, and volume, so that sawdust may be produced at a highly variable rate.

If the sawdust is to be combusted by a burner for the purpose of extracting heat for other uses (such as heating, boiler operation, drying, etc.), the use of a burner having a high TDR enables its operation on continuous basis or at least for longer periods of operation, as desired.

In the wood products industry, as including also the production of charcoal, there is a need also for dealing with smoke and other gases produced during operations. For example, in cooperage operations where barrels are produced for aging of beverages, such as wines or brandies, etc., some types of barrels require that they be charred, as for the aging of various kinds of whiskeys. Charring operations produce smoke which may need to be combusted. So also, in charcoal kilns, the off-gases are sources of environmental pollution, and may also need to be combusted, i.e., by oxygenation combustion.

It would be desirable to combine a burner, capable of burning wood products for the above-noted purposes, with features for combustion of off-gases in the wood products industry.

Present burners in the wood products industries have not met the needs for these kinds of combustion, and have not achieved satisfactory TDR and efficiencies for acceptable usage in the wood products industries.

SUMMARY OF THE INVENTION

Accordingly, the present invention provides various burner embodiments for burning particulate fuel such as so-called green (high moisture content) sawdust, various feed stocks, organics or biomass materials, including solid cellulosic or wood-containing waste, waste wood, and fragments or wood, and all of which may herein be referred to as wood products or particulate organic fuels or materials.

The invention is also concerned with such burners which are capable of combustion of gases, such as off-gases produced in the wood products industry, or other gases which are to be oxygenated or burned for conversion to a condition environmentally non-polluting.

Burners of the present invention achieve high efficiency and flexibility, particularly achieving a very high turndown ratio (TDR).

The inventive burners specifically achieve a high TDR while carrying out combustion of wood products. Burners of the invention are capable of being operated over a great dynamic range.

The new burners are especially useful in wood products manufacturing or processing operations, such as stave and barrel-forming (cooperage) operations which create very substantial quantities of green sawdust.

The new burners, because of their high TDR, efficiency and dynamic range, can be used in operation on continuous basis or for longer periods of operation, and at greatly variable output different as may be desired.

The new burners disclosed are capable of combustion of a high-moisture, low-Btu value fuels not only providing high turndown ratio but also achieving a high heat release ratio, meaning beat output per volume per unit of time. This allows a smaller size burner of the present invention than would be required in a prior art burner, and so the invention results in a burner of lower cost than heretofore.

Another feature of the presently inventive burners is the capability for designing the burners to a desired scale, as according to the intended mode of usage and industry segment in which the burners will serve. Thus, the present burners are easily scalable.

A further advantage of the inventive burners is their use of electronic controls using programmable logic controllers, for achieving precise, efficient, safe and reliable control and operation in all modes of usage.

Yet another feature of the inventive burners is a gas combustor for combustion of smoke and various combustible gases, including off-gases in the wood products industry, such as for example gases produced during cooperage operations and gases produced during the operation of charcoal kilns, as well as other industrial off-gases.

The presently inventive burners achieve satisfactory TDR and efficiencies for acceptable usage in the wood products industries.

In addition, burners of the present invention are economical in construction and operation and are easily installed and operated.

Briefly, the present invention relates to various burner configurations. Each burner of the disclosure exhibits a high turndown ratio for combustion of a principal fuel. The burner includes, or comprises, consists, of or consists essentially of a housing defining an upright combustion chamber lined with refractory material and generally circular in horizontal section, a main combustion region within an upper end of the combustion chamber, an initial combustion zone at a lower end of the combustion chamber of reduced-sized cross-section compared to the combustion chamber, a transition region within the combustion chamber increasing in cross-section from the initial combustion region to the main combustion region, a ceiling of the combustion chamber, a principal fuel feed to supply particulate fuel with combustion air to the initial combustion region for igniting the principal fuel. Multiple sets of tuyeres are provided for controllably introducing combustion air tangentially regions of the combustion chamber for contributing to cyclonic combustion flow in such a manner as to increase diameter of combustion upwardly within the combustion chamber. A counterflow arrangement disrupts cyclonic flow near the ceiling. The ceiling defines an exit for providing escape from the combustion chamber of exhaust gases resulting from combustion in the combustion chamber. The arrangement is such that the principal fuel is ignited in the initial combustion region, and burns with cyclonic flow extending upwardly through the transition region with increasingly greater combustion diameter into the combustion chamber.

Various ignition and control features are also disclosed.

The burner may include a smoke or combustible gas combustor mounted to or connected to the burner for receiving hot combustion exhaust gases of 1,600 degrees F. or greater, which exit into a preheat tube located within a smoke-combustor heating chamber. Smoke or other combustible gases such as off-gases from another process enter the heating chamber through gas tuyeres tangential to walls of the heating chamber. The smoke or gaseous combustibles are heated by the preheat tube. The combustor includes a venturi which creates a negative pressure in the heating chamber for drawing the combustible gases from the heating chamber and from the combustible gas tuyeres. Controlled high-velocity air is forced through the venturi tuyeres, causing the venturi action. Controlling the amount of high-velocity air forced into the venturi tuyeres and the cyclonic tuyeres regulates negative pressure created by the venturi. The high-velocity air also serves as combustion air for ignition of the combustible smoke or gases. More combustion air is forced into the top of the venturi chamber through cyclonic tuyeres, enhancing mixing of the air and combustible gases and causing the gases to burn in a cyclonic pattern in the combustion chamber of the combustor. The combustor can be operated to maintain proper negative pressure for optimum draft control while maintaining the correct amount of air and temperature for combustion of the combustible gases in the combustion chamber.

Other objects and features will be in part apparent and in part pointed out below.

BRIEF DESCRIPTION OF THE DRAWINGS

Corresponding reference characters indicate corresponding parts consistently throughout the several views of drawings.

DETAILED DESCRIPTION OF PRACTICAL EMBODIMENTS

Figure 1:
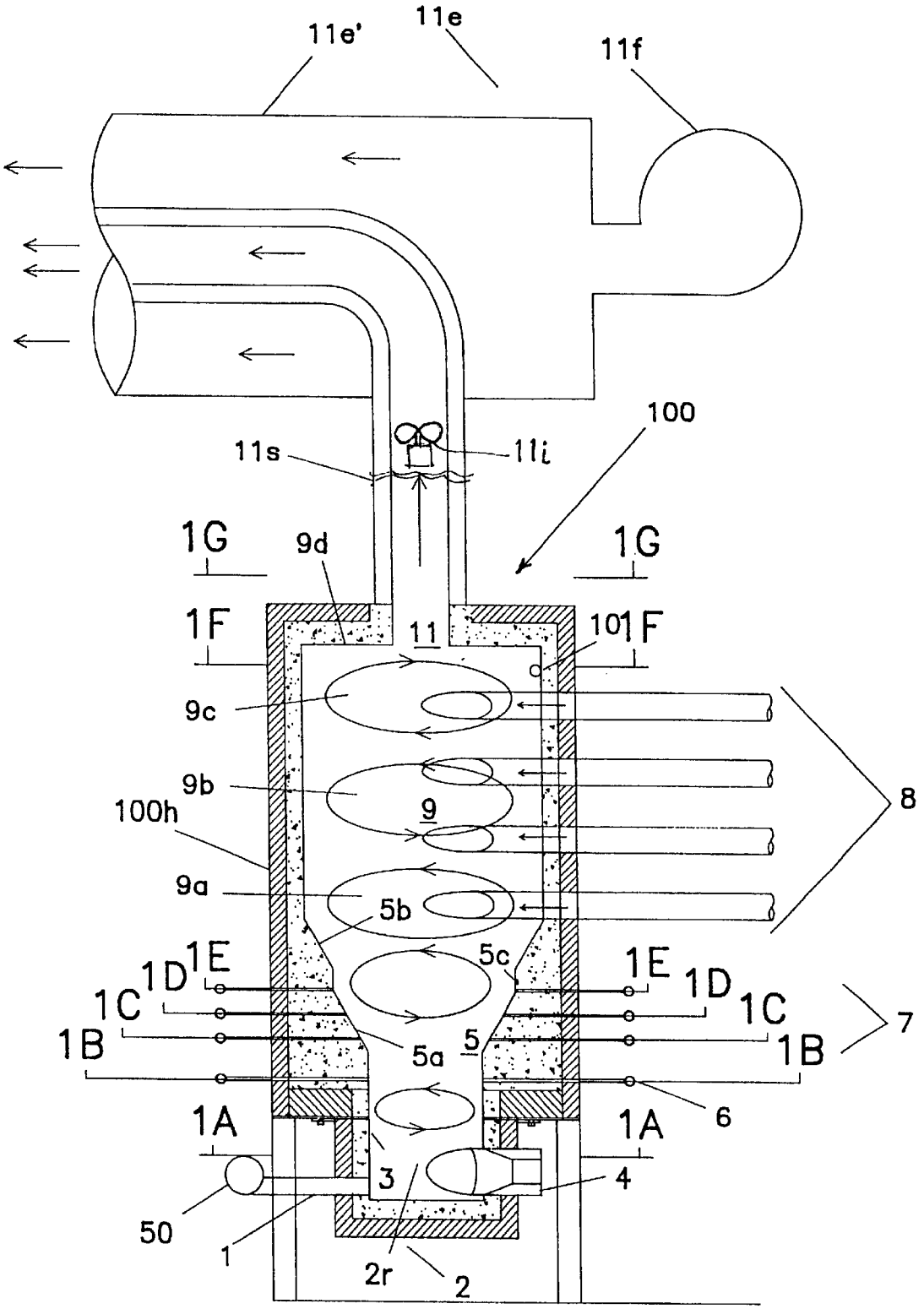
FIG. 1 is a vertical cross-section of a burner, including an ignition can, in accordance with and embodying the present invention.
Figure 1A:
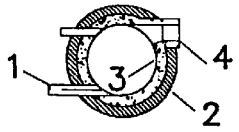
FIGS. 1A through 1G are horizontal cross sections taken along correspondingly numbered section lines of FIG. 1.

A burner 100 as shown in FIG. 1 is designed to burn many types of varying moisture content biomass fuels. However for descriptive purposes the words sawdust or wood will be used to describe the fuel being burned in a burner.

Burner 100 has an external housing 100*h* of generally cylindrical form defining having a lower extension 3 of smaller diameter which extension 2 may for convenience be referred to as an ignition can 2. Can 2, having an inside diameter of constant cross-section, is lined interiorly with refractory-material 3. Can 2 provides for ignition of introduced particulate fuel, e.g., sawdust, and transitions from its reduced diameter initial combustion region 2*r* into a funnel- or cone-shaped transition region 5 and thence upwardly into a main combustion chamber 9, similarly refractory line, such that the horizontal cross-section increases from the initial combustion region 2*r* of can 2 upwardly within the burner to a constant diameter cross-section of combustion chamber 9 which is generally circular in horizontal section. Upper portion of chamber 9 joins a substantially flat combustion chamber ceiling 9*a* ; lined similarly with refractory material, through which an choked exit 11 (or, simply, choke 11) opens centrally into a suitable exhaust stack 11*s*.

Stack 11*s* may communicate, for example with a heat exchanger 11*e* having a shroud 11*e*' through which air may be forced by a fan 11*f*, so as extract heat for other purposes (as for building heating, lumber drying, etc.) for extracting heat from the hot exhaust gases (e.g., at temperatures approaching or exceeding 2000 degrees F. which emerge from the combustion chamber. Thus, stack 11*s* may have an extension 11*s*' extending many feet in length through heat exchanger 11*e*.

A suitable so-called ID (interior diameter) fan 11*i* may be located at a suitable location for extracting the hot gases, and serving to induce a partial pressure within combustion chamber 9. The location and configuration of fan 11*i* will be understood to be symbolic in FIG. 1 rather than representative of actual size and placement. Fan 11*i* is controllable in speed under a PLC control system described below. Fan 11*i* associated with the choke or outlet 11 for drawing gases from the outlet to maintain a partial pressure within the combustion chamber so that combustion air is drawn through the tuyeres into the combustion chamber. It may be seen then that can 2 defines a lower region or extension of combustion chamber 9 via transition region 5, within which the refractory lining may preferably take the form of relatively stepped regions 5*a*, 5*b*, including a short constant-diameter intermediate region 5*c*, for step-wise sloping transition from the interior cylindrical form walls 3 of can 2 upward into combustion chamber regions 9*a* and 9*b* for reasons which will be understood from the following description.

Sawdust is tangentially blown pneumatically into can 2 with combustion air through a tube 1 to the inner refractory 3 lined wall of the ignition can 2. A small material handling fan 50 is close-coupled to a sawdust entry nozzle 1 in the ignition can 2. This allows the material handling fan 50 to sling the sawdust into the ignition can 2. By this burner configuration and method, less air is needed to transport the sawdust, contributing to high turndown ratio (TDR) of the burner, TDR being the maximum firing rate of a burner divided by the minimum firing rate of the burner.

In a practical configuration of burner 100 for sawdust burning, pneumatic sawdust transfer may normally be carried out with a minimum air velocity preferably about 4200 ft. per min., thus at such a velocity which necessarily keeps the sawdust in suspension and therefore transportable even if very small amounts are moved. However, this velocity results in a volume of air much greater than what is needed for complete combustion at lower firing rates. This excess air cools the burner 100 causing flames to extinguish in a burner without the features here described. This is one of the main reasons a conventional pneumatically fired burner cannot achieve a high turndown ratio.

A gas or oil fired burner 4 introduces an auxiliary fuel to supply primary startup temperatures for sawdust ignition. Therefore, the auxiliary fuel, whether it be gas or fuel oil, is provided by burner 4 for ignition of the particulate fuel. The contribution of auxiliary fuel by burner 4 also stabilizes combustion temperatures in the ignition can 2 during normal firing operations. The sawdust as thus ignited and combustion takes place in an annulus or torus concentric about the vertical central axis of the burner and combustion chamber, occurring within the initial combustion region. As combustion occurs cyclonically, as with counterclockwise rotation about such axis, it produces a combustion cyclone, specifically a swirling tornado of flame, which is caused to pass up through the combustion chamber 9. The cyclonic action causes the larger particles to wipe the outer walls of the can 3, stepped cone shaped funnel or transition section 5, and combustion chamber 9, which results in a longer retention time for these particles to achieve combustion. Primary combustion starts to occur in the ignition can 2. The fuel particles rise in temperature, moisture is driven off, and small particles are pyrolized completely. Larger particles rise up in the funnel section 5 and combustion chamber 9 and are pyrolized.

Figure 1B:
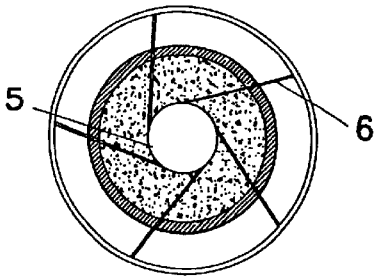
Figure 1C:
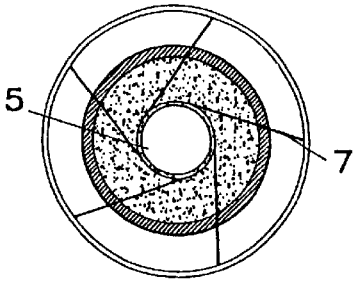
Figure 1D:
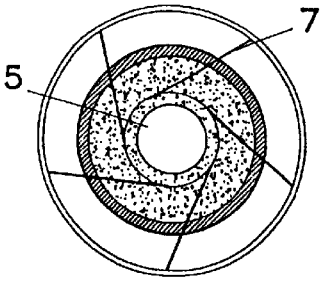
Figure 1E:
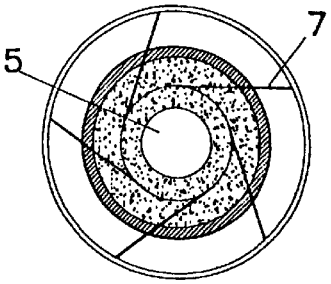
Figure 1F:
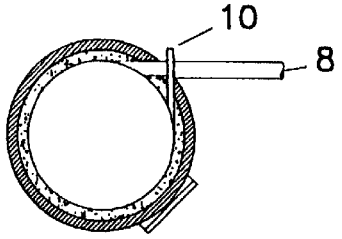
Figure 1G:
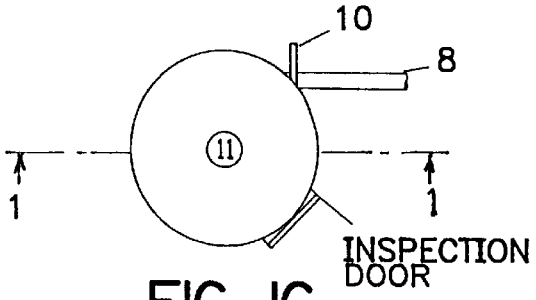

More combustion air is added in the funnel section 5 through cold tuyeres 6 and 7. The cold tuyeres enter air tangentially to the funnel section 5 walls. This air entering tangentially aids the cyclonic action, and helps keep the walls of the funnel section 5 from becoming too hot and keeps sawdust from building up on the funnel section 5 walls. The cold tuyeres 6 and 7, arranged in two tiers or zones, use controlled high-velocity air. (A cross-section view of the first zone is shown in FIG. 1B. Cross-section views of the second zone are shown in FIGS. 1C, 1D, and 1E) This allows the right amount of combustion air to be supplied to each zone maintaining correct temperatures in the funnel section 5 throughout the firing range.

Combustion air is injected tangentially into the combustion chamber 9 of the burner 100 in four tuyeres 8. The combustion airflow through each of the tuyeres is individually controlled by a programmable logic controller (PLC) 37. The PLC 37 controls the combustion airflow by valves and the rotations per minute (RPM) of fans in tuyeres 6, 7 and 8.

Valves installed in each line providing a means of completely sealing off each tuyere. The combustion air completes combustion of the wood and further enhances the cyclonic action causing unburned particles of wood to be thrown against the outer wall until they are burned. This also keeps the outer walls from becoming too hot.

A shear counterflow tuyere 10 is designed to inject controlled high-velocity air tangentially in the top area of the combustion chamber 9 in an opposite direction to the flow created by tuyeres 6, 7 and 8. The shear tuyere 10 air creates a shear zone between the two masses of air, thereby causing a better mixing of air and its components. This mixing action causes improved combustion at higher firing rates. The shear action also extends the flame radially outward closer to the walls. Consequently, the shear tuyere air enables the burner 100 to be fired at a higher firing rate, thus further improving the burner's turndown ratio. The choke 11 prevents unburned particles of wood and charcoal, which are cyclonically driven to the outside walls, from escaping the combustion chamber 9.

The ignition-can 2 is a separate lower extension of the combustion chamber, being bolted onto the burner 100 and can be removed for general maintenance. An ignition tower 13 is designed such that it my be bolted onto the burner 100 at bolt points of ignition can 2. This modular arrangement allows for installation of the ignition tower 13 without necessitating any modifications to the burner. The purpose of the ignition tower 13 is to create a higher turndown ratio as explained in the following paragraphs.

Figure 2:
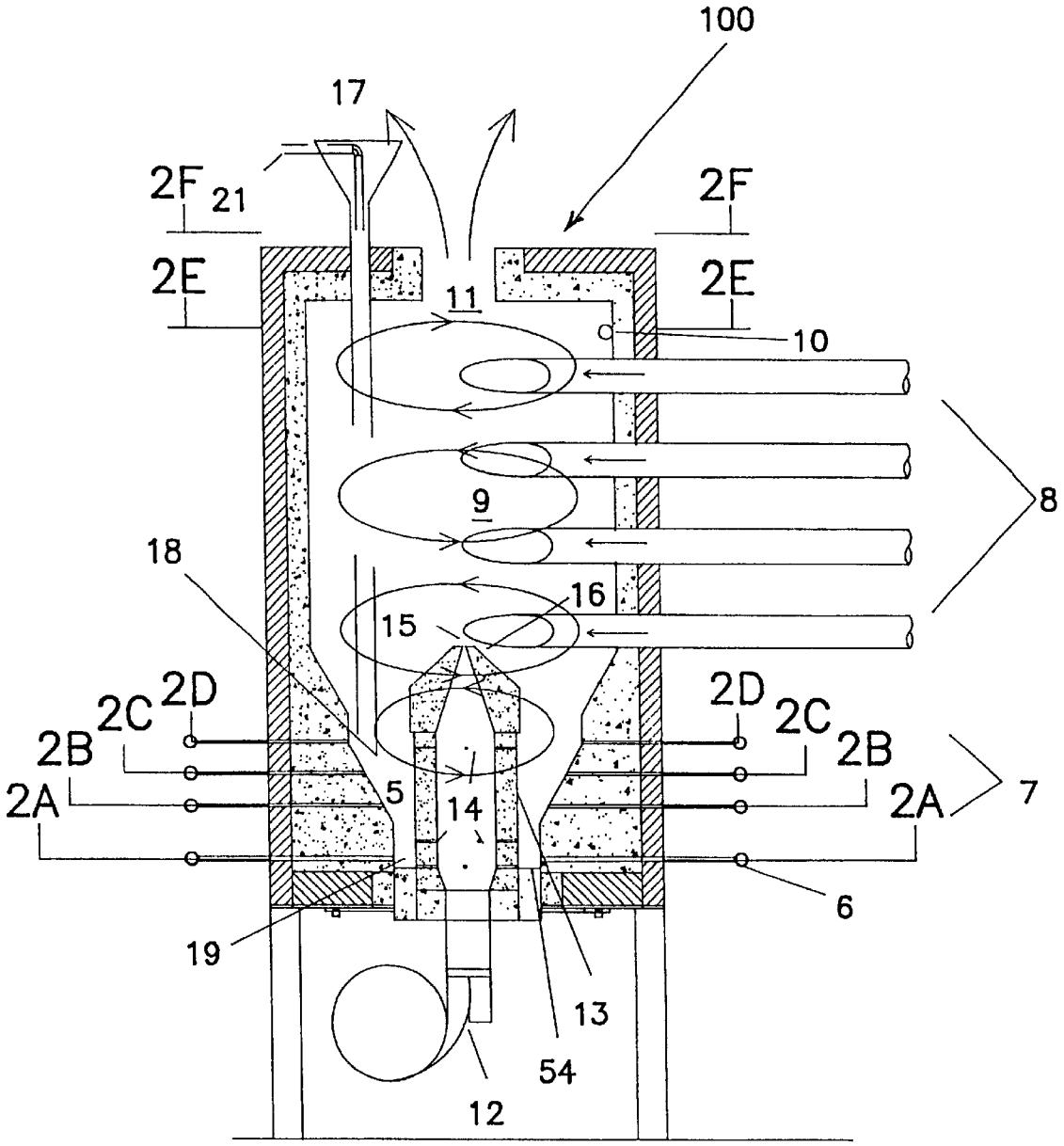
FIGS. 2 is a vertical cross-section of another embodiment of a burner of the invention, including an ignition tower.
Figure 2A:
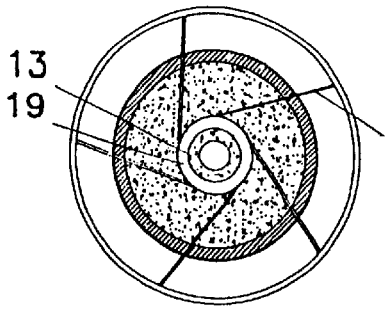
FIGS. 2A through 2F are horizontal cross sections taken along correspondingly numbered section lines of FIG. 2.
Figure 2B:
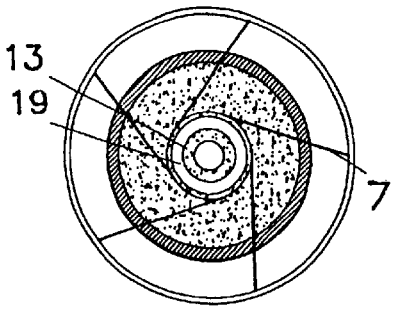
Figure 2C:
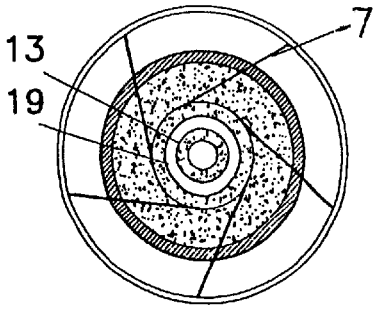
Figure 2D:
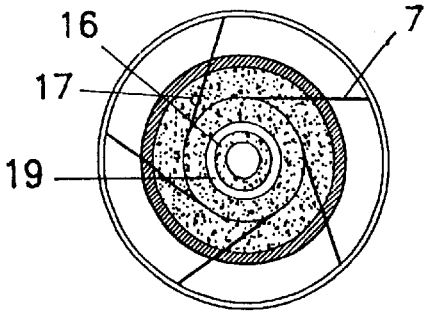
Figure 2E:
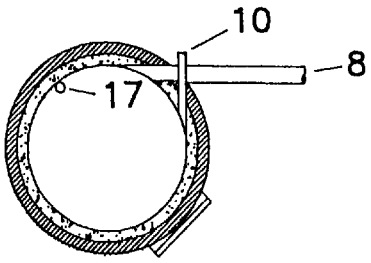
Figure 2F:
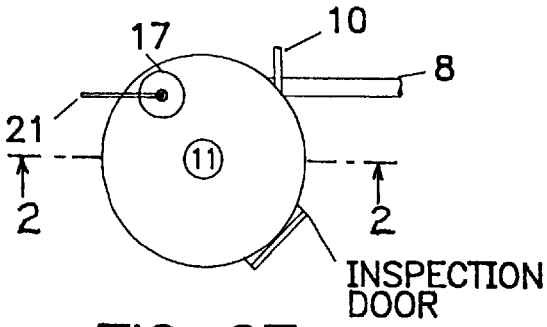

In FIG. 2, a second embodiment comprises a gas or oil fired burner 12 mounted to the bottom of the burner 100. The gas or oil fired burner 12 again introduces auxiliary fuel for ignition purposes. Burner 12 fires vertically up into a hollow interior of the ignition tower 13 which is in the form of a hollow cylinder having a bullet-shaped upper head or end 16. Burner 12 introduces combustion heat into the combustion chamber in this manner, and for this purpose tower 13 includes through its side openings (hot tuyeres) 14 for ignition fuel and ignition air entry into the transition section 5.

Alternative arrangements can be utilized in which a gas or oil fired burner fires tangentially into an ignition can arrangement, similar to the ignition can 2 in FIG. 1. Hot exhaust gases then enter the interior of the ignition tower 13 from the ignition can 2.

The ignition tower 13 is constructed of a suitable heat and abrasion resistant refractory material such as those commercially available under the trademarks Coral Plastic or Mizzou Castable.

Hot ignition gases from an auxiliary gas or oil burner 12 exit the hot tuyeres 14 and radiate out tangentially from the outer wall of the ignition tower 13 into an annulus 19 and into the funnel-shaped transition section 5. These annular or toroidal ignition gases initiate cyclonic combustion, and the combustion gases travel the same direction as the burning wood gases in the burner 100. A small portion of the gas exits through a top opening 15 in a bullet-shaped stabilizing cone 16, which helps form and smooth the flow of flame and gases exiting the funnel section 5.

Hot gases exiting the hot tuyeres are initially heat the ignition tower 13, bullet-shaped stabilizing cone 16, and the surrounding refractory forming the funnel section 5 and annulus 19. After these elements are heated to the point where combustion of the sawdust can begin, the hot exhaust gases exiting the hot tuyeres 14 stabilize the burning of the sawdust and at low fire rates are critical in maintaining combustion. The hot exhaust gases stabilize the burning of the sawdust by driving out moisture and raising its temperature to ignition temperature. These exhaust gases also help keep the ignition tower 13 hot, which radiates heat into the incoming stream of sawdust causing ignition.

Fuel enters into the burner 100 by means of a drop chute 17. The fuel drops directly into an area very close to the vertical center 18 of the funnel section 5. On positive pressure burners, an air curtain is formed by air from a tube 21 which equalizes pressure in the fuel feed tube and prevents gases and sawdust from being blown out of the burner. The downward momentum of the fuel carries the heavier particles such as sawdust and wood into the annulus 19. Combustion air 20 is injected tangentially through tuyeres 6 in the outer walls of the annulus 19. This air in combination with the hot gases exiting from the hot tuyeres 14 causes the sawdust particles to spin with a high velocity inside the annulus 19. The radiant heat created from the burning particles heats the walls of the annulus 19 to very high temperatures. The momentum of hot gases exiting the annulus 19 prevent excess sawdust from entering the annulus 19. This causes more burning in the funnel section 5 during high fire rates. As fuel burns in the annulus 19, the temperature drops allowing more fuel to enter the annulus 19, thereby maintaining an equilibrium temperature when firing at higher firing rates. The annulus 19 is a hot spot allowing only enough fuel into the annulus 19 for complete combustion and preventing a buildup of fuel. Proper airflow is utilized to keep the annulus 19 hot and free of fuel buildup.

The hot gases exiting the hot tuyeres 14 also cause the sawdust particles to heat up faster and burn quicker. The small volume and large area of the annulus 19 results in a large amount of heat release area with high radiant heat causing the particles to heat up fast and burn quickly. This ability to heat the particles quickly is critical to the success of the burner 100 in burning high moisture content fuel because moisture is driven out fast., Wood pyrolysis begins followed by complete combustion. The quicker the wood starts to bum the more stable the fire is and the more responsive the burner is to changes in heat demand. This burner can go from a minimum-firing rate to full fire in a matter of minutes. Another advantage of fast heating and drying of the particles is a smaller burner size. As a result of all of the wet sawdust can be burned efficiently with an extremely high turndown ratio. For example, a turndown of at least 35:1 can be achieved when burning green sawdust.

Figure 4:
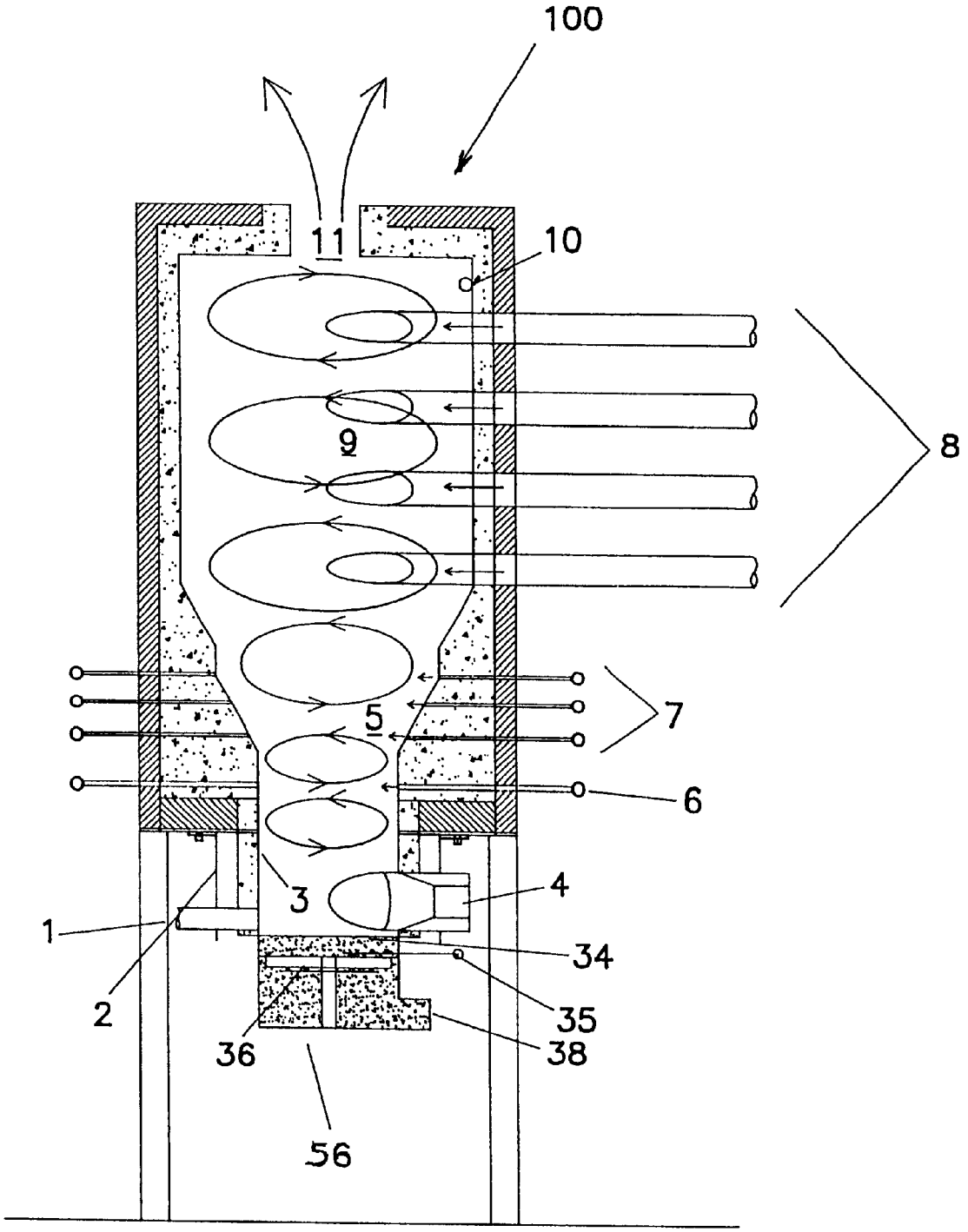
FIG. 4 is a vertical cross-section of another embodiment of a burner of the invention, including an ash removing system.

As the wood particles in the annulus 19 burn and become lighter, the cyclonic action causes the particles to rise out of the annulus into the funnel section 5. The ignition tower 13 continues to provide heat for rapid heating and combustion of particles and gases in the funnel section 5 of the burner 100. More combustion air is injected tangentially into funnel section 5 through tuyeres 7. This air also adds to the cyclonic action and keeps the sawdust in motion. This air also prevents fuel particles from building up on the walls of the funnel section 5. The funnel section 5 expands in area allowing for the expansion of gases coming from the burning fuel. The bullet-shaped stabilizing cone 16 helps to form and smooth the flow of flame and gases exiting the funnel section 5. Other shaped structures can be fitted on top of the ignition tower 13 creating other flame patterns. The hot gases exiting the top of the bullet-shaped stabilizing cone 16 help ignite the gases in the center of the tornado of flame, which helps stabilize the burning gases as they swirl past the cone and meet at the apex of the cone. Controlled high-velocity combustion air is forced into the tuyeres 7. The right amount of air is injected to both keep the particles moving cyclonically and to continue combustion of the sawdust. The funnel section 5 walls are angled up to keep the sawdust in the lower section to enhance combustion of the particles while at the same time preventing piling up of the material which would occur on a flat horizontal surface. More combustion air is injected tangentially to the combustion chamber 9 wall through tuyeres 8. Shear-tuyere air 10 is injected tangentially at a high velocity in an opposite direction to the direction of combustion airflow below. The shear-tuyere air also creates a shearing action and additional turbulence allowing for better air mixing with the gases and therefore better burning. The counter-flow also expands the flame out closer to the wall of the burner 100. The ignition tower 13, funnel 5 and counter-flow air 10 results in a high heat release ratio., For example, 100,000 Btu/cu.ft./hr. has been achieved burning green sawdust. The choke 11 in conjunction with the cyclonic action minimizes the unburned particles of wood from exiting the burner 100. Another embodiment of the burner is shown in FIG. 4. This embodiment utilizes a continuous ash removal system. In this arrangement, the refractory floor 54 of the annulus 19, as shown in FIG. 2, is removed and replaced with a revolving grate removal system 36. The level of ash is maintained at a proper level by means of a temperature-measuring device 35. An ash removal device maintains a solid plug of ash discharge 38 in a container 56 under the burner 100 and discharges the ash into a suitable external container. This method of ash removal is for high ash density and high ash content fuels. The alternative method mentioned previously for burning with the ignition tower 13 utilizing the ignition-an 2 must be used with this ash removal system.

Figure 3:
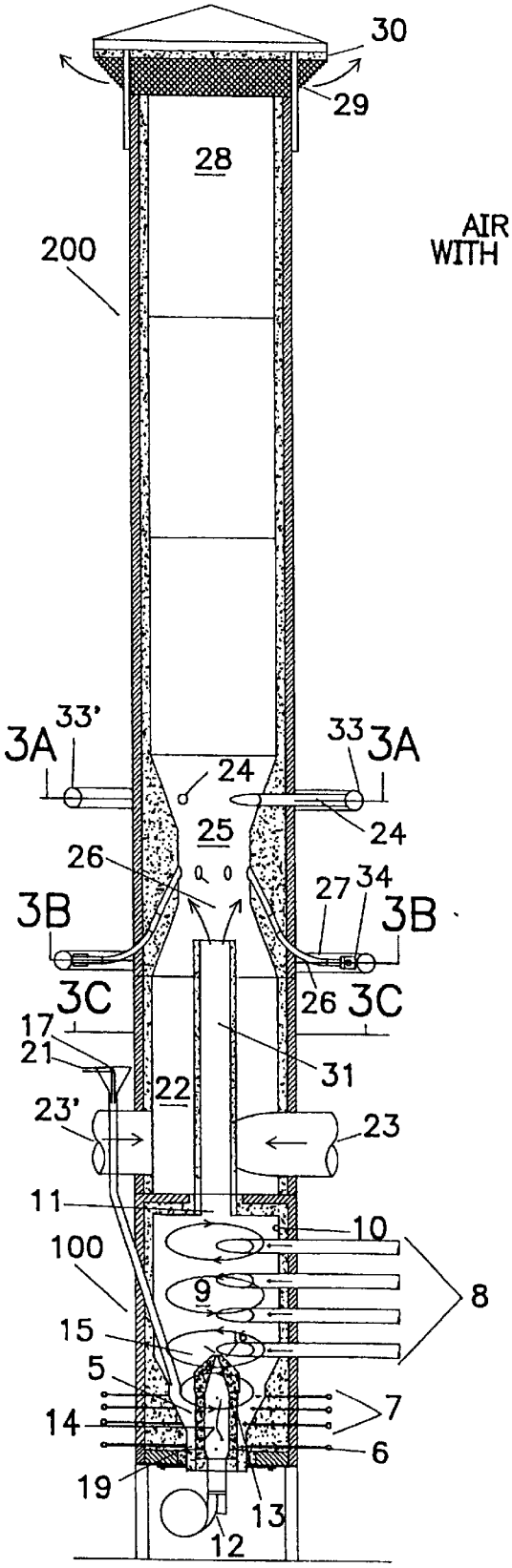
FIG. 3 is a vertical cross-section of another embodiment of a burner of the invention, including a smoke-combustor.
Figure 3A:
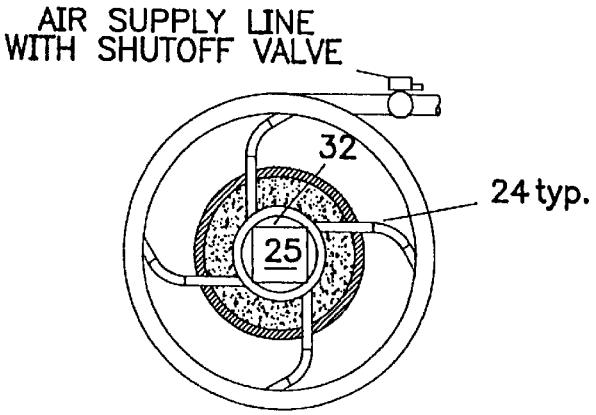
FIGS. 3A–3C are horizontal cross sections taken along correspondingly numbered section lines of FIG. 3.
Figure 3B:
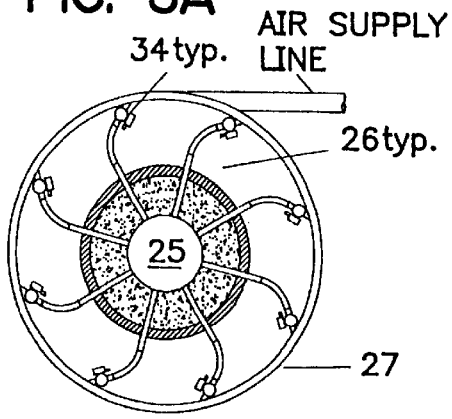
Figure 3C:
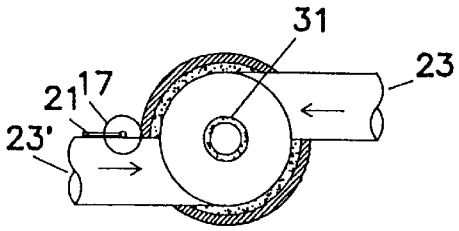

In FIG. 3, a smoke-combustor 200 is mounted to the top of a burner 100. The burner 100 produces hot exhaust gases of 1,600 degrees Fahrenheit or greater, which exit through the choke 11 into a preheat tube 31 located in the smoke-combustor heating chamber 22. Smoke or other combustible gases enter the heating chamber 22 through one or more tuyeres 23 tangential to the heating chamber 22 walls. The smoke or combustibles are heated by the preheat tube 31 in the heating chamber 22. A venturi 25 is built into the smoke-combustor 200, which creates a negative pressure in the heating chamber 22 drawing the combustible gases from the heating chamber 22 and the combustible gas tuyeres 23. Controlled high-velocity air is forced through the venturi tuyeres 26, causing the venturi action. Thus, the venturi tuyeres opening though the sidewalls of the venturi in upwardly inclined. angular relation so as to emerge in the neck of the venturi, controllably and forcibly introducing high-velocity combustion air into the venturi at its narrowest section, accelerating flow venturi with venturi action.

Controlling the amount of high-velocity air forced into the venturi tuyeres 26 and the cyclonic tuyeres 24 regulates negative pressure (i.e., partial pressure) created by the venturi 25. If a larger negative pressure is desired, more air is forced into the venturi tuyeres 26 and less air is forced into the cyclonic tuyeres 24. If less negative pressure is desired more air is forced into the cyclonic tuyeres 24 and less air is forced into the venturi tuyeres 26. The high-velocity air is also the combustion air for ignition of the combustible gases. More combustion air is forced into the top of the venturi chamber 25 through four cyclonic tuyeres 24 in which the air exiting from these tuyeres intersects in a box pattern 32. This method of entering air into the upper venturi chamber enhances the mixing of the air and combustible gases and causes the gases to burn in a cyclonic pattern in the combustion chamber 28. Shut-off valves 34 are located on each venturi tuyere 26. This allows air to be forced into one tuyere or in any combination up to all 6 tuyeres. The ability to force air through one venturi tuyere 26 or any combination gives the capability of creating a high draft with a low volume of air due to the high velocity of air in the venturi tuyeres 26. Because of these capabilities, the smoke-combustor 200 can maintain proper negative pressure for optimum draft control while maintaining the correct amount of air and temperature for combustion of the combustible gases in the combustion chamber 28. A manifold 27 supplies the controlled pressurized air to the venturi tuyeres 26. A second manifold 33 supplies controlled pressurized air to the cyclonic tuyeres 24. A thermocouple in the combustion chamber 28 monitors the temperature, which is used to control the firing rate of the burner 100 and the amount of air coming through the venturi tuyeres 26 and the cyclonic tuyeres 24. A stainless steel screen 29 is placed over the exhaust opening of the chamber to prevent anything from entering the combustion chamber 28 and to create more surface to radiate heat back into the exiting gas stream insuring that all the gas is completely burned. A refractory deflector 30 is also placed above the exhaust opening to radiate heat back into the combustion chamber 28 to aid in maintaining temperature in the combustion chamber 28 for proper combustion. This deflector 30 also prevents anything from entering the combustion chamber 28.

The smoke-combustor can also be mounted at ground level and the exhaust gases from a burner can be ducted into the preheat tube in the smoke-combustor.

Figure 5:
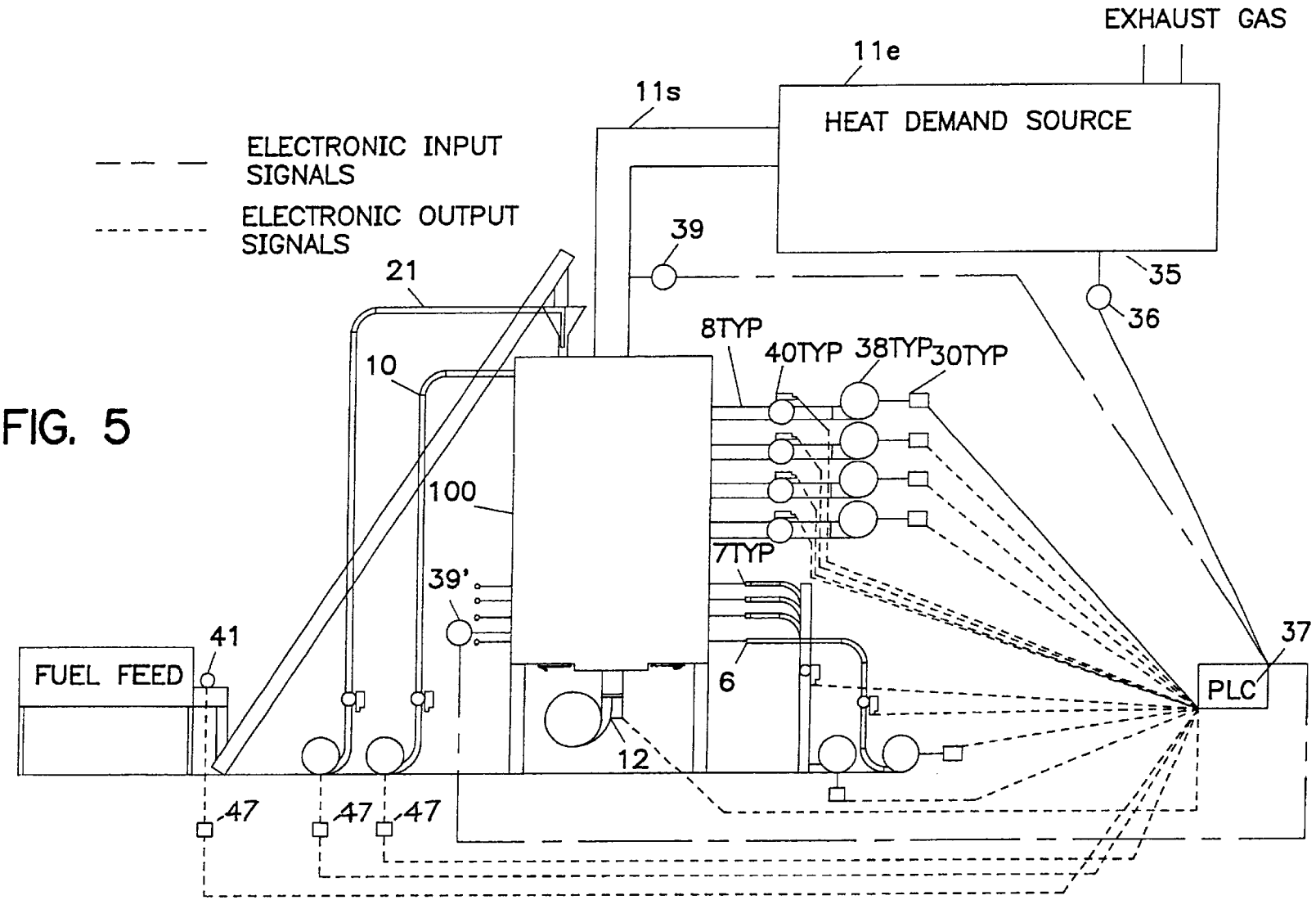
FIG. 5 is a circuit schematic layout diagram of a programmable logic controller, and its connections to various components of a burner of the invention.

FIG. 5 displays a typical burner control scheme. A programmable logic controller (PLC) 37 automatically controls the burner 100 and smoke-combustor 200. The PLC can be any one of the various commercially available systems, such as those commercially sold under the trademarks Allen Bradley and Modicon. The PLC 37 accepts temperature inputs 36 from a heat demand source 35. The burner increases or decreases the amount of beat supplied to the heat demand source 35 based on parameters programmed into the PLC 37. These parameters consist of temperatures that the heat source 35 should be maintained at during any time in the process cycle of heat demand source 35. To maintain the correct temperature, the PLC 37 sends electronic output signals to frequency changers 47 controlling the speed of motors on air blowers 38 and motors on fuel feed motors 41. The air blowers 38 supply all of the air to the burner as described in the previous paragraphs. The PLC 37 also sends electronic signals to valves 40 located in the air supply lines to tuyeres 6, 7, 8 and 10 to further regulate the airflow to the burner 100. The PLC 37 receives temperature signals 39 from the burner 100. It uses the temperature signals 39 to monitor the internal condition of the burner 100 and to make corrections if necessary. Electronic input signals are also received from the gas or oil fired burner 12, which tell the PLC 37 if the burner 100 is operating properly. Other input signals can be transmitted to the PLC 37 signifying the status of motors, blowers, fuel handing equipment, etc., as conditions may dictate. Output signals can be added to operate other peripheral equipment, turn on alarms, provide current data, stored data, etc. as may be required. PLC 37 also regulates the speed of the ID fan (such as that designated 11*i* in FIG. 1) when the latter is part of the system for thereby controlling the extent of partial pressure which results in air being drawn into the tuyeres.

Figure 6:
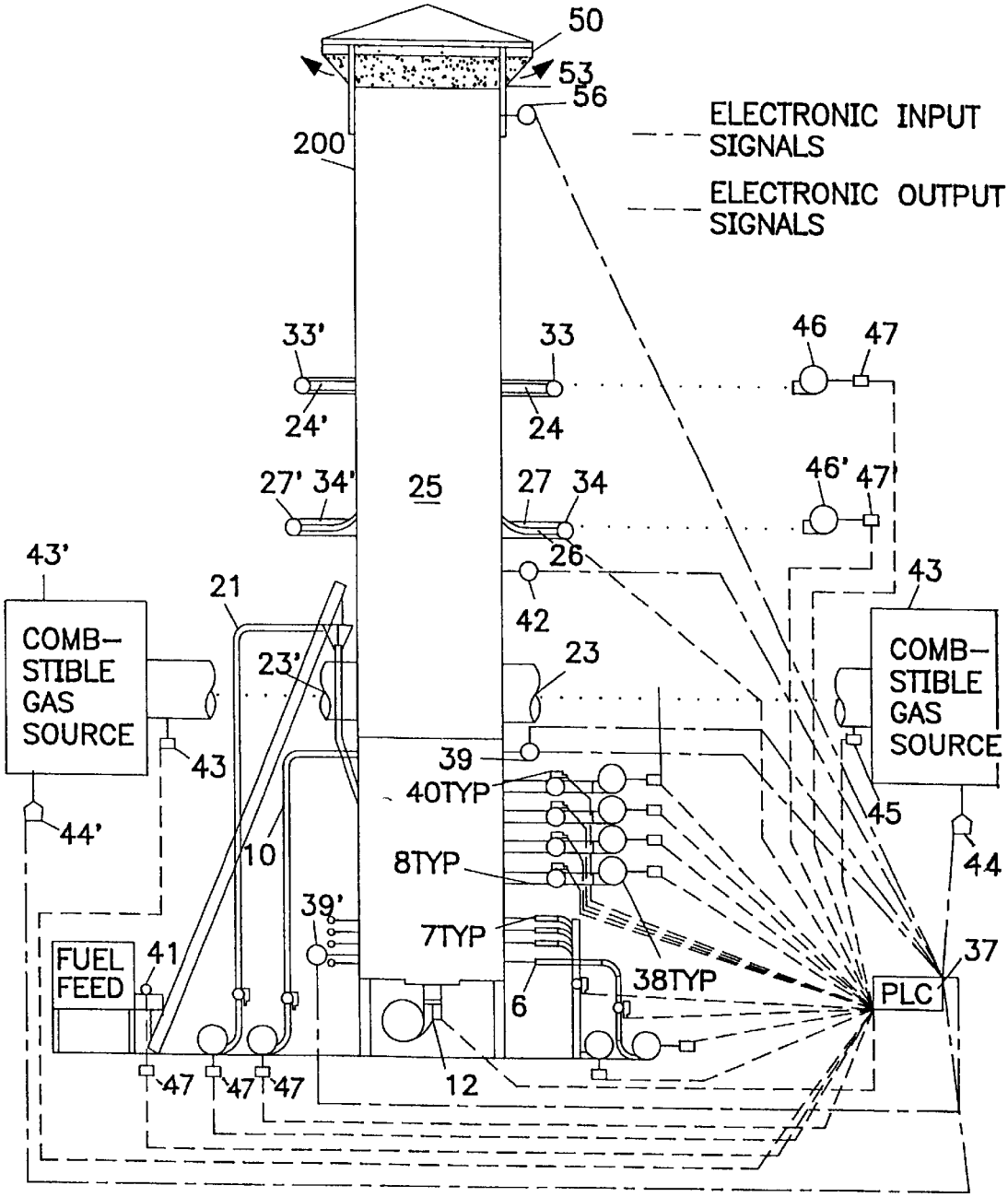
FIG. 6 is a circuit schematic layout diagram of a programmable logic controller and its connections to various components of a combined burner and smoke-combustor of the invention.

FIG. 6 shows a typical control scheme of a burner and smoke-combustor system. A PLC 37 controls both the burner 100 and smoke-combustor 200 for proper temperature and draft to completely combust the combustible gas or smoke produced by a combustible gas source 43. The PLC 37 receives temperature inputs 36 from the smoke-combustor 200. The PLC 37 increases or decreases the firing rate of the burner 100 to maintain a proper temperature for complete gas combustion at the temperature input 36 location. The PLC 37 controls the burner firing rates as described previously. The PLC 37 also receives pressure inputs 44 from the combustible gas sources 43. The PLC 37 sends electronic output signals to frequency changers 47 controlling the speed of motors directly coupled to air blowers 46 attached to venturi tuyeres 26 and cyclonic tuyeres 24 on the smoke-combustor. The PLC 37 also sends electronic output signals to shutoff valves 34 located in the venturi tuyeres 26 and to damper valves 45 located in the combustible gas tuyeres 23 coming from the combustible gas source 43. The PLC 37, utilizing the smoke-combustor venturi 25, maintains the correct draft in the combustible gas source 43 by being able to control the flow in each venturi tuyere 26 and the combustible gas tuyere 23. The PLC 37 does this with valves and the ability to control the volume of air supplied to the tuyeres by varying the speed of air blower 46. Other input signals can be transmitted to the PLC 37 signifying the status of various pieces of equipment. Output signals can be added to control other pieces of equipment, turn on alarms, provide data, etc.

EXAMPLES

Example 1

A practical embodiment of the new burner as according to FIG. 1 or 2 is scaled for small-scale use to provide a maximum output (firing rate) of 3 MBtu/hr, but is capable of operation down to a minimum output of 100 KBtu/hr, and so provides a TDR of 30.

Example 2

A practical embodiment of the new burner is constructed according to FIG. 2 for relatively large-scale use. When operating at maximum output, it achieves a firing rate of about 6.2 MBtu/hr, and is capable of turndown to a minimum output of 100 KBtu/hr, and achieves a TDR of about 62. A heat release ratio of 100,000 Btu/cu.ft./hr. is achieved burning green sawdust.

Example 3

A practical embodiment of the new burner is constructed according to FIG. 2 for burning green sawdust. Ignition is achieved by firing the burner with fuel level to achieve a minimum starting level of 100 Btu/hr. When operating at maximum output, it achieves a firing rate green (wet) sawdust of 3.5 MBtu/hr, so that with operation capable of turndown to a minimum output of 100 KBtu/hr, and thus achieves a TDR of 35. The burner can go from a minimum-firing rate to maximum output in a few minutes.

In view of the foregoing description of the present invention and practical embodiments it will be seen that the several objects of the invention are achieved and other advantages are attained. The embodiments and examples were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting.

The breadth and scope of the present invention should not be limited by any of the above-described exemplary embodiments, but should be defined only in accordance with the claims appended hereto and their equivalents.

What is claimed is:

1. A burner having a high turndown ration for combustion of a principal fuel, the burner comprising:

a housing defining an upright combustion chamber lined with refractory material and generally circular in horizontal section, a main combustion region within the combustion chamber, an initial combustion region at a lower end of the combustion chamber of reduced-size cross-section compared to the combustion chamber, a transition region within the combustion chamber increasing in cross-section from the initial combustion region to the main combustion region, a ceiling of the combustion chamber, a principal fuel feed to supply particulate fuel with combustion air to the initial combustion region, an auxiliary fuel feed to supply ignition fuel to the initial combustion region for igniting the principal fuel, multiple sets of tuyeres for controllably introducing combustion air tangentially into regions of the combustion chamber for contributing to cyclonic combustion flow in such a manner as to increase diameter of combustion upwardly within the combustion chamber, counterflow means within the combustion chamber for disrupting cyclonic flow near the ceiling, the ceiling defining an exit for providing escape from the combustion chamber of exhaust gases resulting from combustion in the combustion chamber, whereby the principal fuel is ignited in the initial combustion region, and burns with cyclonic flow extending upwardly through the transition region with increasingly greater combustion diameter into the combustion chamber.

2. A burner as set forth in claim 1 wherein combustion takes place in an annulus within the initial combustion region.

3. A burner as set forth in claim 1 wherein the principal fuel is particulate.

4. A burner as set forth in claim 1 wherein the particulate fuel is sawdust.

5. A burner as set forth in claim 1 wherein the initial combustion region comprises an ignition tower extending upwardly into the combustion chamber within the transition region, the ignition tower being provided with an ignition burner fired by the auxiliary fuel feed, the ignition tower being configured such that it introduces heat from combustion of the auxiliary fuel to the initial combustion region for igniting the principal fuel.

6. A burner as set forth in claim 5 wherein the ignition tower defines about it a annulus within the ignition section in which the principal fuel is ignited for combustion with annular cyclonic flow.

7. A burner as set forth in claim 6 wherein the ignition tower is of cylindrical form, having a central bore through which the ignition burner provides combustion heat, and the tower defines about it an annulus in the ignition section in which annulus the principal fuel is ignited for combustion with annular, cyclonic flow.

8. A burner as set forth in claim 7 wherein the tower includes a bullet-shaped upper end, the upper end including at least one opening for discharge flow of combustion heat from the ignition burner to helps form and smooth the flow of combustion gases within the transition section.

9. A burner as set forth in claim 7 wherein the principal feed is particulate in nature, and the principal fuel feed comprises a drop chute for continuously dropping particulate fuel directly into an area within the transition zone, such that particulate fuel is introduced into the initial combustion and entrained by combustion air injected tangentially within the annulus for ignition therein and cyclonic combustion with the combustion air in a rising spiral within the combustion chamber such that as the particulate fuel is burned still more particulate fuel may continually enter the annulus by the drop chute.

* * * * *

UNITED STATES PATENT AND TRADEMARK OFFICE

CERTIFICATE OF CORRECTION

PATENT NO. : 6,269,755 B1
DATED : August 7, 2001
INVENTOR(S) : John J. Boswell et al.

It is certified that error appears in the above-identified patent and that said Letters Patent is hereby corrected as shown below:

Column 7,
Line 18, replace "tuyeres are initially" with -- tuyeres initially --.
Line 63, replace "fast," with -- fast --.
Line 65, replace "bum" with -- burn --.

Column 8,
Line 41, replace "ratio," with -- ratio --.
Line 57, replace "iginition-an 2" with -- iginition-can 2 --.

Column 9,
Line 63, replace "beat" with -- heat --.

Column 12,
Line 46, replace "zone" with -- region --.
Line 48, replace "and entrained" with -- region and entrained --.

Signed and Sealed this

Sixth Day of August, 2002

*Attest:*

*Attesting Officer*

JAMES E. ROGAN
*Director of the United States Patent and Trademark Office*